US010295962B2

(12) United States Patent
Klopfenstein et al.

(10) Patent No.: US 10,295,962 B2
(45) Date of Patent: May 21, 2019

(54) METHOD FOR TESTING THE RATE OF A QUARTZ WATCH

(71) Applicant: ETA SA Manufacture Horlogere Suisse, Grenchen (CH)

(72) Inventors: Francois Klopfenstein, Delemont (CH); Yves Godat, Cornaux (CH); Nicolas Jeannet, Chambrelien (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 208 days.

(21) Appl. No.: 15/340,286

(22) Filed: Nov. 1, 2016

(65) Prior Publication Data

US 2017/0139377 A1 May 18, 2017

(30) Foreign Application Priority Data

Nov. 13, 2015 (EP) ..... 15194568

(51) Int. Cl.
*G04D 7/00* (2006.01)
*G04D 7/12* (2006.01)
(Continued)

(52) U.S. Cl.
CPC ..... *G04D 7/1207* (2013.01); *G04C 3/107* (2013.01); *G04C 3/108* (2013.01); *G04C 3/12* (2013.01);
(Continued)

(58) Field of Classification Search
CPC ..... G04D 7/1207; G04D 7/003; G04C 3/107; G04C 3/108; G04C 3/12; G04G 3/022; G04G 3/04; G06F 7/68
See application file for complete search history.

(56) References Cited

U.S. PATENT DOCUMENTS 4,761,771 A 8/1988 Moriya et al.
5,719,827 A * 2/1998 Diep ..... H03L 1/026 368/202
(Continued)

FOREIGN PATENT DOCUMENTS

EP 0 427 077 A1 5/1991
EP 0 711 040 A1 5/1996
EP 1 089 145 A1 4/2001

OTHER PUBLICATIONS

European Search Report dated Apr. 26, 2016 in European Application 15194568, filed on Nov. 13, 2015 ( with English Translation of categories of Cited Documents).

*Primary Examiner* — Eric S. McCall
*Assistant Examiner* — Timothy P Graves
(74) *Attorney, Agent, or Firm* — Oblon, McClelland, Maier & Neustadt, L.L.P.

(57) ABSTRACT

The method for test the rate of an electronic watch with a time base device (1) comprises three main steps for the test on test equipment. The time base device comprises at least one watch module (2) with a resonator (3) connected to an oscillator of an electronic circuit (4), which is followed by a divider circuit, which is controlled by an inhibition circuit, and which provides a divided timing signal for a motor. In a first step, a measurement is made of the frequency of the oscillator reference signal in at least one measurement period without inhibition. A second step is provided for acquiring the current inhibition value to inhibit a certain number of clock pulses in a subsequently inhibition period and to determine the inhibition value. Finally, a third step is provided for calculating the corresponding rate frequency of the watch.

20 Claims, 2 Drawing Sheets

(51) Int. Cl.

| | |
|---|---|
| ***G04C 3/12*** | (2006.01) |
| ***G04C 3/10*** | (2006.01) |
| ***G04G 3/02*** | (2006.01) |
| ***G04G 3/04*** | (2006.01) |

(52) U.S. Cl.
CPC ..... *G04D 7/003* (2013.01); *G04G 3/022* (2013.01); *G04G 3/04* (2013.01)

(56) References Cited

U.S. PATENT DOCUMENTS

| | | | | |
|---|---|---|---|---|
| 6,768,704 | B1 * | 7/2004 | Kawaguchi | G04D 7/003 318/17 |
| 2004/0233794 | A1 * | 11/2004 | Maruyama | G04C 3/12 368/157 |
| 2014/0152355 | A1 * | 6/2014 | Godat | G04G 3/022 327/117 |

* cited by examiner

METHOD FOR TESTING THE RATE OF A QUARTZ WATCH

This application claims priority from European Patent application 15194568.0 of Nov. 13, 2015, the entire disclosure of which is hereby incorporated herein by reference.

FIELD OF THE INVENTION

The present invention concerns a method for testing the rate or operation of an electronic watch, such as a quartz watch.

The invention also concerns a time base device for a timepiece circuit integrating a test mode for the accelerated measurement of the rate or clock frequency of an electronic watch.

BACKGROUND OF THE INVENTION

In industrial production, it is difficult to produce oscillators having a well-defined reference frequency, in order to obtain, at the output of a series of dividers, timing pulses at a reference unit frequency, such as at 1 Hz. Such oscillators are generally arranged to be produced at the end of the production phase with a reference frequency in a slightly higher frequency range. This makes it possible, over base or inhibition periods, for example having a duration of around a minute, to deliberately inhibit one or more clock pulses by means of an inhibition circuit in order to correct on average the reference frequency.

To improve the precision of the time base clock frequency, it may also be envisaged to increase the inhibition period, but the maximum error between two time measurements increases in proportion to the factor of increase of the inhibition period. Increasing the inhibition period to increase precision does not allow for accurate checking of the clock frequency over a short period. The test time cannot be determined simply on the basis of a certain number of successive inhibition periods, which constitutes a drawback.

The Patent Application CH 707 285 A2 describes a method for regulating a quartz oscillator for an electronic watch. To achieve this, it is provided that some pulses are inhibited over a defined period. With the method described, it is possible to increase the precision of the electronic watch movement ensuring that it can be successfully certified by a certification body, such as the COSC (Swiss Official Chronometer Testing Institute) in Switzerland. However, the timepiece circuit is not configured to be capable of changing into an accelerated test mode, which constitutes a drawback.

The Patent Application WO 2014/095538 A2 may be cited, which discloses a thermocompensated chronometer circuit. The electronic watch includes at least one electric motor for driving the time display hands. It also includes a watch module with a time base, which supplies a clock signal connected to a divider chain to supply a reference clock signal for controlling the electric motor. The watch module further includes a measurement and correction circuit between the time base and the dividers, so as to supply a temperature compensation signal to the watch module. There is not, however, described a watch module capable of being configured to be placed in an accelerated test mode for an electronic watch rate test method, which constitutes a drawback.

In order to measure the proper rate of a quartz watch, particularly to determine its time-keeping precision over a long period, the watch must be tested. Generally speaking, this test is performed on measuring equipment by detecting the pulses from the motor, which is clocked to the second, via a magnetic coupling. The duration of an end of production test is long, given that to accurately determine the proper rate of the watch, close to 4 hours of testing are required, which constitutes a drawback of this type of test.

A time base device for a timepiece circuit of an electronic watch includes a watch module having a 32 kHz quartz crystal, which operates in conjunction with an integrated watch circuit. This integrated circuit thus includes an oscillator connected to the quartz, a temperature sensor, a temperature compensation circuit, a circuit for adjustment of the clock frequency by inhibition, and a motor pulse generator. To achieve high precision, the time base device effects an inhibition cycle with a long period. For example, such a circuit can effect inhibition at a frequency of 16 kHz with a resolution of ±1 clock pulse every 960 seconds, i.e. every 16 minutes. This corresponds to 61 μs every 960 seconds or 0.0636 ppm or 2.005 seconds per year.

There are practical difficulties in calibrating and checking the time base device during the manufacturing method. According to the prior art, in order to check the frequency accuracy of the watch, it is necessary to accurately measure the time between motor pulses over a relatively long period, typically around 16 minutes, as indicated above. This long time period requires heavy and expensive equipment, which is produced, for example by Witschi Electronic AG. This equipment is capable of measuring products in batches, for example a batch of 32 pieces, which are measured within the 16 minutes. This equates to a production of 2 pieces per minute, but is still relatively long for performing the test, which constitutes a drawback.

SUMMARY OF THE INVENTION

It is therefore a main object of the invention to overcome the aforementioned drawbacks by proposing a method for testing the rate or operation of an electronic watch, such as a quartz watch, which makes it possible to drastically accelerate the frequency measurement during production, while obviating the need for complicated test equipment that is expensive to implement.

To this end, the present invention concerns a method for testing the rate or operation of an electronic watch with a time base device on test equipment, the time base device being configured to be capable of changing from a normal operating mode to a test mode, and comprising at least one watch module powered by an energy source, the watch module comprising a quartz resonator connected to an electronic circuit provided with a reference oscillator directly connected to the quartz resonator to provide a reference signal to a divider circuit having a number D of divider stages, where D is an integer number equal to or greater than 1, the divider circuit being controlled by an inhibition circuit controlled by an inhibition value and providing a timing signal with a divided frequency for the control of at least one electric motor or of a time display device, wherein the test method includes the steps of:

in a first step, measuring the frequency of the reference signal from the reference oscillator in a first number M of measurement periods without inhibition, where M is an integer number, which is equal to or greater than 1, and each measurement period is defined between two pulses of the timing signal, in a second step, acquiring the inhibition value for the inhibition circuit, in order to inhibit a certain number of pulses in the divider circuit, and measuring the frequency of a signal related to the reference signal with inhibition in a second number N of successive measurement periods with inhibition, where N is an integer number, which is equal to or greater than 1, so as to determine the inhibition value by knowing the reference signal frequency, and in a third step, calculating the exact rate frequency of the time base device via a dedicated algorithm in the test equipment based on the measurements of the first and second steps after M+N measurement periods, which defines a measurement cycle.

Particular steps of the test method are defined in the dependent claims 2 to 10.

One advantage of the method for testing the rate or running or operation of an electronic watch according to the invention lies in the fact that it comprises only three main steps for effecting this accelerated test. After configuration of the watch module in test mode, and in a first step, there is effected a measurement of the clock frequency generated, in particular, by the oscillator or after at least one division stage of the series of frequency dividers. This clock frequency measurement is effected without inhibition. A second step is provided for acquiring the current inhibition value, which can be applied by a temperature compensation circuit to inhibit a certain number of clock pulses in one inhibition period. Finally, a third step is provided for calculating the corresponding frequency of the watch, i.e. the rate or operation of said electronic watch.

Advantageously, to effect the rate test method, it is sufficient to accomplish the first two steps in a test duration of around 6 seconds, while maintaining good measurement precision. In the prior art, up to 4 hours of testing were required to ensure good test method precision. A temperature correction value is also taken into account during the electronic watch rate test method. The temperature is measured both during the measurement and the calculation of the rate frequency.

To this end, the invention also concerns a time base device for an electronic watch suitable for implementing the test method, wherein the time base device is configured to be able to change from a normal operating mode to a test mode, and comprises at least one watch module powered by an energy source, wherein the watch module includes a quartz resonator connected to an electronic circuit provided with a reference oscillator directly connected to the quartz resonator to provide a reference signal to a divider circuit having a number D of divider stages, wherein D is an integer number equal to or greater than 1, the divider circuit being controlled by an inhibition circuit controlled by an inhibition value and providing a divided frequency timing signal to control at least one electric motor.

Particular embodiments of the time base device are defined in the dependent claims 12 to 17.

BRIEF DESCRIPTION OF THE DRAWINGS

The objects, advantages and features of the method for testing the rate or operation of an electronic watch, and the time base device for implementing the test method will appear more clearly in the following, non-limiting description with reference to the drawings, in which.

DETAILED DESCRIPTION OF THE INVENTION

In the following description, all those components of a time base device for a timepiece circuit of the electronic watch for implementing the test method, which are well known to those skilled in the art in this technical field, are described only in a simplified manner.

Figure 1:
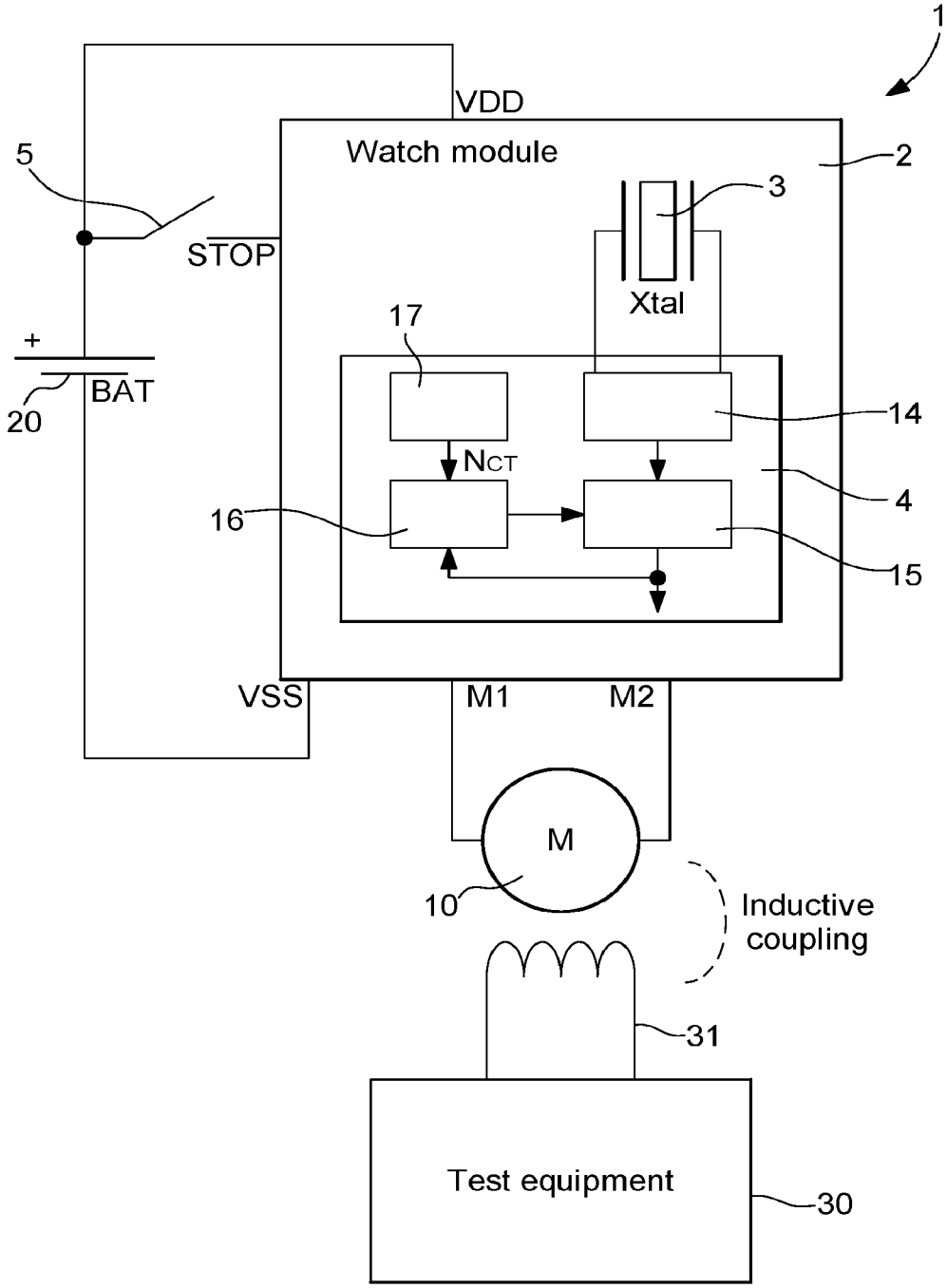
FIG. 1 shows a schematic view of a first embodiment of the components of a time base device for testing the operation of the watch in cooperation with test equipment according to the invention.

Time base device 1 for a timepiece circuit of the electronic watch is represented schematically in FIG. 1 according to a first embodiment. This time base device 1 is placed on test equipment 30 in a selected test mode. Test equipment 30 detects the drive pulses for at least one electric motor 10 for moving the watch hands via an inductive coupling by means of a coil 31. Detection may be effected in a routine manner on a test bench through the case of the electronic watch. However, it may also be envisaged to establish a direct contact with the timepiece circuit to effect the electronic watch rate test before time base device 1 is enclosed in a watch case.

Time base device 1 for a timepiece circuit of the electronic watch mainly includes an electronic watch module 2. This watch module 2 comprises a conventional 32 kHz quartz resonator 3, which is connected to an integrated electronic circuit 4. A quartz resonator component of the Micro Crystal CM7 or Micro Crystal WM-132X-C7 type may be used for electronic watch module 2. However, other types of resonator components of the quartz or MEMS type may also be used for said electronic module, also at frequencies other than 32 kHz.

Electronic circuit 4 mainly includes a reference oscillator 14, which is directly connected to quartz resonator 3 to generate a periodic reference signal, whose reference frequency is close to 32 kHz. Electronic circuit 4 also includes a divider circuit 15, which is connected to the output of reference oscillator 14 and which is composed of a number D of divider stages, where D is an integer number equal to or greater than 1. The divider stages are dividers in series in order to divide the reference signal frequency. Circuit divider 15 mainly provides, for example, a clock signal at the unit frequency (1 Hz). This clock signal may also be adapted in a signal control unit in order to transmit a drive pulse signal to at least one electric motor 10, connected by two wires to terminals M1, M2 of watch module 2. A battery 20 is also provided for powering watch module 2. A switch 5 may also be provided in order to control the watch module test mode.

As indicated in the aforementioned prior art, the desired normal frequency must, in principle, be at an exact value of 32.768 Hz for the proper operating rate of the electronic watch. However, the reference oscillator is deliberately arranged to provide a reference signal whose reference frequency is slightly higher than the desired normal frequency. This reference frequency is, in principle, calibrated to operate between 0 and 127 ppm above the intended value of the normal frequency. A frequency correction is effected in one of the divider stages of the divider circuit in every measurement cycle or period by inhibiting a certain number of pulses in one of the first stages of the divider circuit. This principle is described with reference to FIG. 1 and in paragraphs 8 to 13 of the description of EP Patent Application 2 916 193 A1, which is incorporated herein by reference.

It is to be noted that electronic circuit 4 also includes an inhibition circuit 16 for correcting on average the reference frequency. Preferably, inhibition circuit 16 receives the timing signal from divider circuit 15 and acts, for example, on the second stage of the divider circuit, where the signal frequency is at a frequency close to 16 kHz. Electronic circuit 4 may also include a temperature sensor, a temperature compensation circuit 17, a circuit for adjustment of the clock frequency by inhibition, and a motor pulse generator circuit, which receives the clock signal from the divider circuit. Temperature compensation circuit 17 can also adapt and provide inhibition value $N_{CT}$ to inhibition circuit 16. Control of the signals in electronic circuit 4 may be effected in a conventional manner by a processor or a finite-state machine.

Inhibition value $N_{CT}$ may be the temperature correction parameter. It can be expressed by the following formula $N_{CT}=K\cdot((F_Q/F_N)-1)$, where $F_N$ is the precise desired normal frequency (32.768 Hz) and $F_Q$ is the reference frequency of oscillator 14, which is generally slightly higher than the normal frequency. Factor K is chosen to facilitate implementation in electronic integrated circuit 4, while taking account of the principle of inhibition which consists in removing an integer number of clock pulses. Normally, inhibition value $N_{CT}$ is determined to act on the second divider stage with the normal frequency $F_N$ divided by two, and the oscillator frequency $F_Q$ divided by two. An integer number of clock pulses to be inhibited is provided by inhibition circuit 16 based on value $N_{CT}$ in each inhibition period. This inhibition period is, in principle, a base period determined between each clock pulse at the divider circuit output, notably between each drive pulse for at least one motor 10. Since the range of adaptation of quartz oscillator 14 is between 0 and 127 ppm, it is possible to take a typical value of $N_{CT}=K\cdot 98$ ppm. This inhibition value is stored in a register, which may be used during test mode.

Using temperature compensation circuit 17, value $N_{CT}$ is typically calculated to perform a $x^2$ quadratic correction of frequency $F_Q$ as a function of temperature. Value $N_{CT}$ is then stored in a specific register. Further, in an improved mode, it is also desired to compensate 3rd or 4th order effects, which may be due to features of the resonator or to the non-linearity of the temperature sensor. In such case, $N_{CT}=a\cdot x^4+b\cdot x^3+c\cdot x^2+d\cdot x+e$, where x relates to temperature, and e is not temperature dependent, but depends on the quartz offset. The term $c\cdot x^2$ generally concerns the quartz frequency, whose temperature dependence is generally parabolic with a peak at 25° C. The parameters a, b, c, d and e can be determined based on measurements at different temperatures and/or on theoretical or empirical knowledge of quartz resonator 3 and the temperature sensor preferably integrated in electronic circuit 4. It is to be noted that this temperature sensor may actually be an oscillator devised to generate a frequency $F_T$ having significant linear temperature dependence. These parameters a, b, c, d and e may thus be determined with several measurements of the frequency of each oscillator at various temperatures. These parameters are calibrated before the method for testing time base device 1 and, in principle, with measurements at several temperatures, in particular at 9 temperatures.

As indicated above, the test method can be started by action on a switch 5. This switch can be closed to enter the test mode automatically, or manually by action, in particular, on a push-button or crown of a chronograph movement of the electronic watch. It may also be provided that the switch is closed upon activation of the battery 20. For automatic entry into the test mode, it may be provided to write to a memory register in watch module 2 for activation of the test mode during a defined time period. The test method in test mode is accelerated according to the invention as specified hereafter, and may have a duration, for example, of around 6 to 7 seconds.

Figure 2:
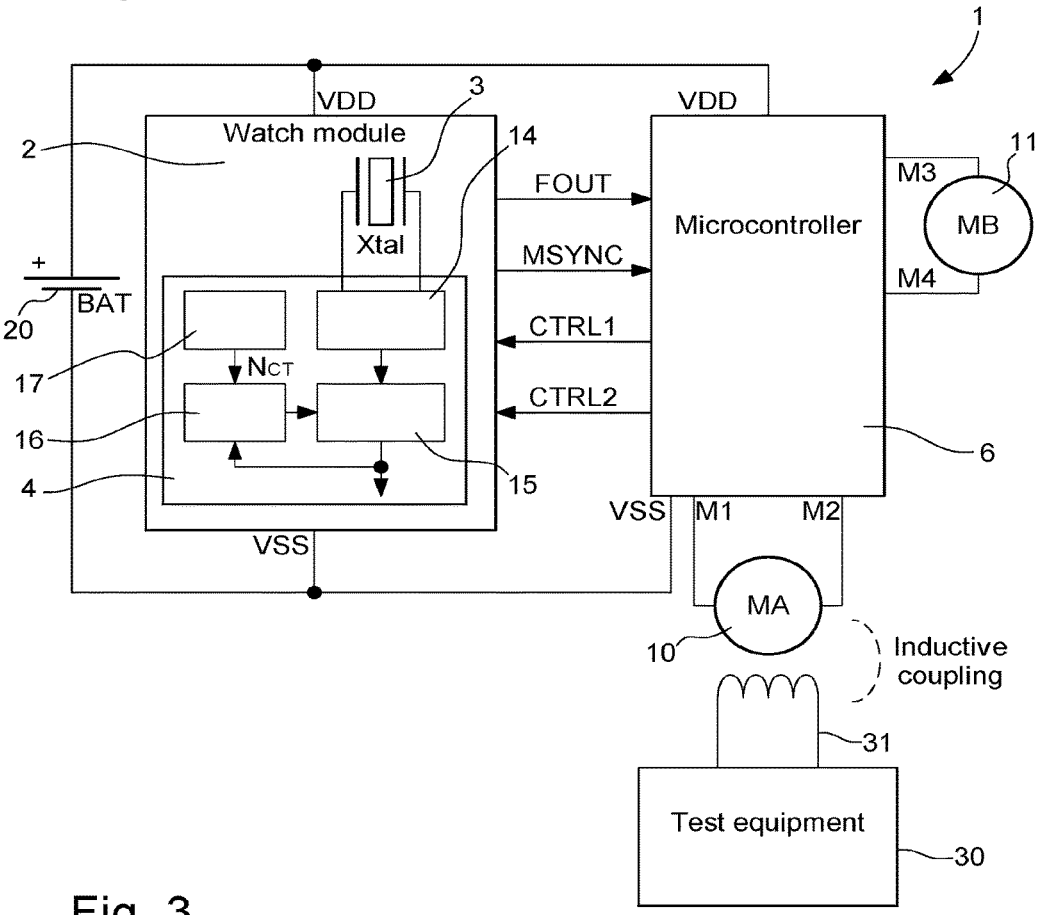
FIG. 2 shows a schematic view of a second embodiment of the components of a time base device for testing the operation of the watch in cooperation with test equipment according to the invention.

A second embodiment of time base device 1 for a timepiece circuit of the electronic watch is represented schematically in FIG. 2. In this second embodiment, time base device 1 may also be placed on test equipment 30 in a selected test mode, wherein a magnetic coupling by means of a coil 31 can detect the drive pulses for at least one electric motor 10, 11 for moving the watch hands. It may also be envisaged to establish a direct contact with the timepiece circuit to effect the electronic watch rate test before it is enclosed in a watch case.

Time base device 1 for the timepiece circuit of the electronic watch includes a watch module 2, which includes a 32 kHz quartz resonator 3. This resonator 3 is connected to an integrated circuit 4. Electronic circuit 4 includes a reference oscillator 14, which is directly connected to quartz resonator 3 to generate a reference signal. Normally, the normal frequency of this reference signal is close to 32 kHz, but the reference signal is at a calibrated reference frequency to operate between 0 and 127 ppm above the intended value of the normal frequency.

Electronic circuit 4 also includes a divider circuit 15, which is connected to the output of reference oscillator 14 and which is composed of a number D of divider stages, which are dividers in series for dividing the reference signal frequency. Generally, as in the first embodiment, divider circuit 15 can include up to 15 divider stages, i.e. 15 dividers-by-two connected one after the other from the oscillator output to the output of watch module 2. The clock signal at the output of the last divider stage of the divider circuit of watch module 2 may be at a frequency close to the unit frequency (1 Hz).

In this second embodiment, time base device 1 also includes a microcontroller 6 connected to watch module 2. A battery 20 powers watch module 2 and microcontroller 6. Microcontroller 6 can receive the timing signal MSYNC from watch module 2, and a clock signal FOUT, which may either be the reference signal from the oscillator or the output signal from the last divider stage or second divider stage of divider circuit 15. Timing signal MSYCN can also be adapted in microcontroller 6 to transmit a first pulse signal to a first motor MA 10 at terminals M1, M2 of microcontroller 6, and a second pulse signal to a second motor MB 11 at terminals M3, M4. In normal operation, the first motor can be clocked at a frequency of 1 Hz to drive one or two hands, whereas the second motor can be clocked at a frequency higher or lower than 1 Hz, for example, to drive other hands. Microcontroller 6 can also be controlled by an RC oscillator, which, if needed, can be disconnected in the selected test mode.

It may also be provided that microcontroller 6 allows electronic circuit 4 of watch module 2 to directly drive, via timing signal MSYNC, the first motor 10 used to control frequency in relation to test equipment 30.

Microcontroller 6 also controls watch module 2, via a first control signal CTRL1, which may be a serial communication line, in order to adapt some parameters of said watch module following a test or for a calibration operation.

Microcontroller 6 also transmits second control signal CTRL2, which is an automatic control signal to start and end the test mode.

The method for testing the rate or operation of the electronic watch will now be described on the basis of the first embodiment or the second embodiment of time base device 1 of the timepiece circuit. Preferably, first motor 10 is clocked at a base frequency, which may be a frequency of around 1 Hz. It therefore receives a pulse signal for the rotation of its rotor. The motor is a Lavet type motor with two rotor poles for rotation. A measurement period is defined as the inverse of the base frequency and, in this case, around 1 second, in principle, between two motor pulses. This defines a base or inhibition period, which depends on the clock signal at the output of divider circuit 15. Since the measurement is effected with each drive pulse generated for at least one motor, the measurement period may vary slightly, if one inhibition is effected per measurement period.

The method generally includes three main steps for measuring the proper rate of the electronic watch in one measurement cycle. A first measurement step is effected during a first number M of measurement periods without inhibition, where M is an integer number, which is equal to or greater than 1. A second measurement step is effected following the M measurement periods, during a second number N of measurement periods with inhibition, where N is an integer number equal to or greater than 1. In a third step at the end of the N measurement periods, a simple algorithm is applied by the measuring equipment to calculate the frequency of oscillator 14 and the inhibition value in order to determine the exact watch frequency based on the measurements made in the M+N measurement periods. The frequency of oscillator 14 can be calculated immediately during the M measurement periods.

Figure 3:
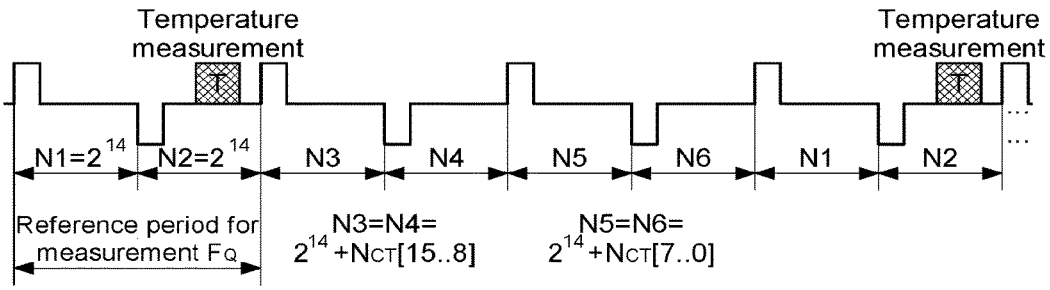
FIG. 3 shows a graph of pulses supplied to at least one motor of the time base device setting out two steps of the method for testing the electronic watch rate.

In a preferred embodiment, there is provided a 6 second measurement cycle. The first number M of measurement periods is equal to 2, and the second number N of successive measurement periods is equal to 4, as explained hereafter. As can be seen in the graph of FIG. 3, the base or inhibition period is of a duration Tb, which is equal to around 1 second, but varies slightly according to the duration of the M measurement periods or of the N measurement periods.

For the first step without inhibition, given that action with or without inhibition is effected in the second stage of the divider circuit, the number of pulses for the first measurement period T1 between the first motor pulse and the second motor pulse is a number N1 equal to $2^{14}$ pulses, which corresponds to 16,384 pulses. The number of pulses in the second successive measurement period T2 between the second motor pulse and the third motor pulse is a number N2 equal to $2^{14}$ pulses, which corresponds to 16,384 pulses. The frequency $F_Q$ of the oscillator reference signal can be calculated in the reference measurement period T1+T2 of 2 seconds between the first and third motor pulses. The measuring equipment can thus easily calculate the exact clock frequency $F_Q$ of reference oscillator 14.

It is to be noted that this reference frequency could be calculated in a 1 second base period by a measurement between the first and second motor pulses. However, in that case, the polarity of the motor could not be the same, which may slightly affect the detection of the first edge of the motor pulse by the inductive sensor in the measuring equipment. Thus, measurement in a 2 second period between the first and third motor pulses is preferred, with an odd or even number of pulses of the same polarity, as shown in FIG. 3.

For the second step with inhibition, there is used the binary inhibition value $N_{CT}$ which is a binary P-bit word, where P is an integer number greater than or equal to 1 and preferably 16 bits [15 . . . 0]. Time base device 1 transmits this current temperature-compensated inhibition value to inhibition circuit 16. It is generally temperature compensation circuit 17, which supplies this inhibition value $N_{CT}$. Thus, in the third and fourth successive measurement periods T3 and T4 represented by N3 and N4, there are added to the number of base pulses, notably to the $2^{14}$ pulses, the 8 most significant bits (MSB) of inhibition value $N_{CT}$[15 . . . 8] from 8 to 15. The 8 most significant bits of inhibition value $N_{CT}$ are thus added for the number N3 between the third and fourth motor pulses and for the number N4 between the fourth and fifth motor pulses.

It is to be noted that, by taking the inhibition value, the third and fourth measurement values T3 and T4 are each greater than duration T1 or T2. The 8 most significant bits (MSB) of inhibition value $N_{CT}$[15 . . . 8] give the equation $N_{CT}[15 \ldots 8]=\mathrm{INT}(N1\cdot((T3/T1)-1))$, where T3 is the third measurement period and T1 is the first measurement period. In this equation, INT takes the integer portion of the content in parenthesis.

Thus, in the fifth and sixth successive measurement periods T5 and T6 represented by N5 and N6, there are added to the number of base pulses, notably to the $2^{14}$ pulses, the 8 least significant bits (LSB) of inhibition value $N_{CT}$[7 . . . 0] from 0 to 7. The 8 least significant bits of inhibition value $N_{CT}$ are thus added for the number N5 between the fifth and sixth motor pulses and for the number N6 between the sixth and seventh motor pulses. As above, the 8 least significant bits (LSB) of inhibition value $N_{CT}$[7 . . . 0] give the equation $N_{CT}[7 \ldots 0]=\mathrm{INT}(N1\cdot((T5/T1)-1))$, where T5 is the fifth measurement period and T1 is the first measurement period. Since it knows the exact clock frequency of the first step, the measuring equipment will be capable of determining the inhibition values in the second step and of reconstructing the current temperature-compensated inhibition value $N_{CT}$.

During the third step, a simple algorithm is applied by the measuring equipment to calculate the exact frequency of the watch, which is usually called the rate of the watch. A detailed description will not be given here of how the time base device uses inhibition value $N_{CT}$, which is described in the Patent Application EP 2 916 193 A1, which is incorporated herein by reference. However, it will be recalled that the 16-bit binary value $N_{CT}$ makes it possible to obtain an adjustment precision of ±0.12 seconds per year. Previously, for such high precision in production in the prior art, more than 4 hours of testing would be required. The present invention, however, theoretically reduces this time to 6 seconds. However, in a real case, the 6 second measurement will be slightly less precise due to oscillator jitter and to other timing errors in acquisition of the inductive edges of the motor pulses. In practice, measurement accuracy can be increased by increasing the measurement time, preferably in measurement cycles in multiples of 6 seconds.

Of course, to make an accurate measurement, it is important to control the temperature at the moment of measurement and to provide an updated temperature correction value in order to perform this accelerated test. As represented in FIG. 3, it may be envisaged to measure the temperature by a sensor (not shown) in each second measurement period T2 of a measurement cycle. For the equipment to be able to check the stability of the frequency and, indirectly, the temperature during the test, the frequency may thus be evaluated over 5 double periods of 2 seconds each for the first and second measurement periods T1+T2, for the second and third measurement periods T2+T3, for the third and fourth measurement periods T3+T4, for the fourth and fifth measurement periods T4+T5, and for the fifth and sixth measurement periods T5+T6. The temperature measurement is preferably effected between the second and third measurement periods. Once the test equipment has determined value $N_{CT}$, it will also be able to exactly calculate the frequency for each of the 5 aforementioned periods and deduce the frequency stability therefrom. The mean value of these 5 measurements can also be calculated to attenuate the effect of oscillator jitter.

As previously indicated, it is important to measure at the start of the periods for N1, N3, N5 or N2, N4, N6 to take account of the change in drive polarity of the electric motor rotor.

Once the electronic watch rate test has been effected, it may be provided to correct the rate of the watch. The correction or one or more parameters may be transmitted wirelessly to the watch control circuit, which can act as a data receiver. It may also be provided to communicate via an optical channel, preferably in the visible or infra-red range, possibly through a transparent portion of the external part of the watch. The inhibition value can also be corrected via an electrical contact of the time base device or by wireless transmission.

From the description that has just been given, several variant embodiments of the method for testing the rate or operation of an electronic watch, and the time base device for the electronic watch for implementation of the method, can be devised by those skilled in the art without departing from the scope of the invention defined by the claims. Several series of measurement cycles can be effected to determine the oscillator reference frequency and for correction of the inhibition value. The first measurement step may comprise a single measurement period, whereas the second measurement step may comprise a single measurement period or two measurement periods. With two measurement periods in the second step, the high-order bits of the inhibition value are transmitted to the inhibition circuit in a first measurement period, whereas the low-order bits of the inhibition value are transmitted to the inhibition circuit in a second measurement period. Instead of an electric motor, the watch module may also control a time display device.

What is claimed is:

1. A test method for testing on test equipment a rate of a time base device, the time base device being configured to be capable of changing from a normal operating mode to a test mode, and comprising at least one watch module powered by an energy source, the watch module comprising a quartz resonator connected to an electronic circuit provided with a reference oscillator directly connected to the quartz resonator to provide a reference signal to a divider circuit having D divider stages, where D is an integer number equal to or greater than 1, the divider circuit being controlled by an inhibition circuit controlled by an inhibition value and providing a timing signal with a divided frequency, wherein the test method includes the steps of:

measuring the frequency of pulses of the tuning signal corresponding to a number of base pulses of the reference signal from the reference oscillator in M successive measurement periods, where M is an integer number equal to or greater than 1, measuring, in N successive measurement periods where N is an integer number greater than or equal to 2, respectively, (1) the frequency of pulses of the timing signal corresponding to the number of base pulses of the reference signal concatenated with a number of pulses representing a first subset of bits of the inhibition value, and (2) the frequency of pulses of the timing signal corresponding to the number of base pulses of the reference signal concatenated with a number of pulses representing a second subset of bits of the inhibition value, wherein the inhibition value is a p-bit multi-bit binary word, and calculating a rate frequency of the time base device based on the frequency measurements of the timing signals after a measurement cycle of M+N successive measurement periods.

2. The test method according to claim 1, wherein the time base device comprises at least one electric motor and the test equipment is adapted to determine, by direct electric contact or by inductive coupling via an inductive coupling coil, when the pulses of the timing signal are being applied to the electric motor.

3. The test method according to claim 1, wherein the inhibition circuit acts on a second divider stage of the divider circuit when the time base device is not in test mode.

4. The test method according to claim 3, wherein the inhibition value is a 16-bit word, wherein the first subset of bits are the 8 high-order bits of the inhibition value, $N_{CT}[15 \ldots 8]$, and the second subset of bits are the 8 low-order bits, $N_{CT}[7 \ldots 0]$, of the inhibition value.

5. The test method according to claim 4, wherein M is equal to 2, and N is equal to 4 to define a measurement cycle close to 6 seconds, and wherein the divider circuit includes 15 divider stages, wherein a first measurement period T1 and a second measurement period T2 are each equal to the reference signal frequency of the oscillator divided by $2^{15}$, wherein two successive measurement periods T3 and T4 of the 4 measurement periods correspond to the 8 high-order bits $N_{CT}[15 \ldots 8]$ of the inhibition value being provided to the second stage of the divider circuit, and wherein two successive measurement periods T5 and T6 of the 4 measurement periods correspond to the 8 low order bits $N_{CT}[7 \ldots 0]$.

6. The test method according to claim 1, further comprising repeating several measurement cycles to determine the inhibition value.

7. The test method according to claim 1, wherein a temperature measurement is effected in cooperation with a temperature compensation circuit of the inhibition value of the electronic circuit in at least one of the M measurement periods.

8. The test method according to claim 7, wherein a stability of the rate frequency and of the temperature measurement is evaluated over 5 double measurement periods in the measurement cycle.

9. The test method according to claim 1, further comprising correcting the inhibition value of the time base device after an end of the measurement cycle.

10. The test method as claimed in claim 1, wherein the pulses of the timing signal corresponding to a number of base pulses of the reference signal comprise pulses of a same polarity.

11. The test method according to claim 1, wherein the inhibition value is a 16-bit word, wherein the first subset of bits are the 8 high-order bits of the inhibition value, $N_{CT}[15 \ldots 8]$, and the second subset of bits are the 8 low-order bits, $N_{CT}[7 \ldots 0]$, of the inhibition value.

12. A time base device for an electronic watch, wherein the time base device is configured to change from a normal operating mode to a test mode, comprising:

at least one watch module powered by an energy source, wherein the watch module includes:

at least one electric motor;

a quartz resonator;

an inhibition circuit;

a divider circuit having D divider stages, wherein D is an integer number equal to or greater than 1;

an electronic circuit, including a register for storing an inhibition value, connected to the quartz resonator, wherein the electronic circuit is provided with a reference oscillator directly connected to the quartz resonator to provide a reference signal to the divider circuit, wherein the divider circuit is controlled by the inhibition circuit to provide a divided frequency timing signal to control the at least one electric motor; and the electronic circuit further comprising circuitry configured to, while in the test mode:

output pulses of the timing signal corresponding to a number of base pulses of the reference signal from the reference oscillator in M successive periods of the timing signal, where M is an integer number equal to or greater than 1, output pulses of the timing signal, in N successive periods of the timing signal where N is an integer number greater than or equal to 2, wherein (1) first pulses of the timing signal correspond to the number of base pulses of the reference signal concatenated with a number of pulses representing a first subset of bits of the inhibition value, and (2) second pulses of the timing signal correspond to the number of base pulses of the reference signal concatenated with a number of pulses representing a second subset of bits of the inhibition value, wherein the inhibition value is a p-bit multi-bit binary word.

13. The time base device according to claim 12, wherein D is equal to 15.

14. The time base device according to claim 13, wherein the inhibition value is a 16-bit binary word stored in the register and provided to the inhibition circuit to act on a second divider stage of the D divider stages.

15. The time base device according to claim 14, wherein the inhibition circuit is arranged to provide 8 high-order bits of the inhibition value in first successive periods of the timing signal and to provide 8 low-order bits of the inhibition value in second successive periods of the timing signal.

16. The time base device according to claim 12, wherein the time base device is configured to enter the test mode manually or automatically by the action of a switch.

17. The time base device according to claim 12, wherein the at least one electric motor comprises two electric motors and the time base device comprises a microcontroller connected to control the two electric motors, and wherein the microcontroller is arranged to transmit the timing signal to one of the two electric motors.

18. The time base device according to claim 12, wherein the electronic circuit comprises a processor to directly control a timing of the timing pulses for the at least one electric motor.

19. The time base device as claimed in claim 12, wherein the output pulses of the timing signal corresponding to a number of base pulses of the reference signal from the reference oscillator comprise output pulses of a same polarity.

20. The time base device as claimed in claim 15, wherein the D divider stages comprises 15 divider stages.

* * * * *